US007424844B2

(12) United States Patent
Carter

(10) Patent No.: US 7,424,844 B2
(45) Date of Patent: Sep. 16, 2008

(54) PORTABLE BALLISTIC SHIELD

(76) Inventor: Kevin Carter, 6400 Wiethora Dr., Waco, TX (US) 76710

( * ) Notice: Subject to any disclaimer, the term of this patent is extended or adjusted under 35 U.S.C. 154(b) by 142 days.

(21) Appl. No.: 11/357,937

(22) Filed: Feb. 17, 2006

(65) Prior Publication Data

US 2007/0193441 A1 Aug. 23, 2007

(51) Int. Cl.
*F41H 5/08* (2006.01)

(52) U.S. Cl. ..... 89/36.07; 89/36.05

(58) Field of Classification Search ..... 89/36.01, 89/36.05–36.07

See application file for complete search history.

(56) References Cited

U.S. PATENT DOCUMENTS 1,301,293 A * 4/1919 Molvig ..... 89/36.06
2,109,831 A * 3/1938 Szalkay ..... 109/49.5
3,855,898 A * 12/1974 McDonald ..... 89/36.08
4,412,495 A * 11/1983 Sankar ..... 109/49.5
4,843,947 A * 7/1989 Bauer et al. ..... 89/36.05
5,293,807 A * 3/1994 Hajdu ..... 89/36.07
D359,820 S * 6/1995 Thumb et al. ..... D29/100
5,533,778 A * 7/1996 Sheridan ..... 296/152
5,756,922 A * 5/1998 Fuller ..... 89/36.02
5,811,719 A * 9/1998 Madden, Jr. ..... 89/36.08
6,647,857 B1 * 11/2003 Newkirk ..... 89/36.08
6,807,890 B1 * 10/2004 Fuqua ..... 89/36.02
7,243,590 B2 * 7/2007 McClellan et al. ..... 89/36.06
2004/0089143 A1 * 5/2004 Gilon ..... 89/36.01

* cited by examiner

*Primary Examiner*—Bret Hayes
(74) *Attorney, Agent, or Firm*—Patrick Stellitano, P.C.

(57) ABSTRACT

The present invention is directed toward an apparatus for tactical ballistic protection for an individual. In particular, the present invention provides a portable device for dual use as a ballistic shield and a rifle mounting stand. The invention is comprised on a ballistic blanket attached to dual ballistic resistant transparent panes. The transparent panes are attached via a vertical hinge, at which the attachment point functions as a rifle mounting stand. The invention may be attached to existing structures via a combination of straps and hooks, or the device may be used free standing.

15 Claims, 4 Drawing Sheets

PORTABLE BALLISTIC SHIELD

BACKGROUND OF THE INVENTION

1. Field of the Invention

The present invention is directed toward an apparatus for tactical ballistic protection. In particular, the present invention provides a portable device for dual use as a ballistic shield and a rifle mounting stand.

2. Background Information

Police enforcement and military personnel have long desired the ability to safely fire upon a target with relative protection from return fire. To these ends, countless structures have been designed and built in an effort to ensure the appropriate level of protection. These structures range from reinforced buildings to armor plated vehicles as well as numerous variations in between.

However, as police and military tactics have changed, so has their need for ballistic protection. Traditional law enforcement and military tactics traditionally involved outnumbering and overpowering the adversary. However, tactics of both forces have changed to involve much more individualized, stealthy operations. Furthermore, these new tactics rely on mobile, forces of individual personnel operating on the ground in close proximity of the target with very little ballistic cover.

Currently, a number of ballistic, protective devices are available and, work well for their intended purposes; however, no known products provide the versatility of the current invention with the incorporation of a rifle stand while still providing complete ballistic protection. Of course, armor plating has been around for years, but it is heavy and cumbersome and lacks the ability to be used by individuals in mobile tactics. More recently ballistic blankets and bullet resistant, polycarbonate shields have been developed. However, although these devices work well, they lack the provisions necessary to allow law enforcement or military personnel to fire upon a target without significant exposure during the process of aiming and firing. Thus, current ballistic protection devices fail to provide a portable structure wherein an individual may monitor, aim, and fire upon a target while remaining under the cover of ballistic protection.

In view of the limitations of products currently known in the art, a tremendous need exists for a ballistic protection device that is portable, versatile, and allows personnel to monitor, aim, and fire upon a target while retaining ballistic protection. Applicant's invention, by its novel design provides a solution in view of currently available devices.

SUMMARY OF THE INVENTION

In view of the foregoing, it is an object of the present invention to provide a device for ballistic protection of individual personnel that is portable.

It is another object of the present invention to provide a device for ballistic protection of individual personnel that is versatile.

It is another object of the present invention to provide a device for ballistic protection of individual personnel that allows an individual to monitor a target while retaining cover from return fire.

It is another object of the present invention to provide a device for ballistic protection of individual personnel that allows an individual to aim a firearm at a target while retaining cover from return fire.

It is another object of the present invention to provide a device for ballistic protection of individual personnel that allows an individual to fire upon a target while retaining cover from return fire.

It is another object of the present invention to provide a device for ballistic protection of individual personnel that provides a rifle stand for an individual to aim a firearm at a target while retaining cover from return fire.

In satisfaction of these and other related objectives, the present invention provides a device for mobile ballistic protection for law enforcement or military personnel. Furthermore, the device of the present invention allows individual personnel to transport and set-up the device for use by attaching to a number of existing structures. Most importantly, the device provides ballistic cover to an individual while allowing the individual to monitor the target while aiming a firearm at the target as well as firing upon the target, all without exposing the individual to return fire.

The device of the present invention is comprised of a ballistic blanket member attached to a vertically hinged bullet resistant polycarbonate member. The ballistic blanket member can be selected from any number of grades of ballistic blankets currently known in the art; preferably, the ballistic blanket member is selected based on balancing the need for mobility and individual transportability of the device versus the need for varying levels of ballistic protection. In other words, the lower the grade of the ballistic protection, the lighter and less bulky the device is for transportation, but the device would be less able to withstand heavy fire from high caliber weaponry. In contrast, the higher the grade of ballistic blanket, the greater the protection from high caliber fire; however, the device becomes heavier and more bulky to transport and set-up than its lighter version. Thus, no matter what the specific need, the device may be tailored for the proper protection/transportability ratio, while still maintaining the integrity of the current invention.

As preciously stated, the device of the current invention is further comprised of a dual-panel, bullet resistant, polycarbonate member. The two panes are connected via a centrally located hinge member. Additionally, the panes are cut in such a way that provides a rifle mounting location between the panes at the centrally located hinge member. This characteristic of the current invention, in novel but elegant fashion, provides the individual user with the ability to monitor the target, maintain aim upon the target, and fire upon the target all while in the cover of the ballistic protection of the device.

Finally, an additional, novel attribute of the present invention lies in the ease with which it may be quickly set-up using any number of existing structures as a base. For instance, the device of the current invention provides the individual personnel a series of attached straps and hooks. One method in which these straps and hooks may be used to set-up the present invention is to secure the device to the trunk of a tree leaving the bulk of the device standing off to one side of the tree, thus increasing the overall ballistic protection to the individual by the diameter of the tree trunk. Additionally, the device of the present invention may be set up via the hooks on the hood of a law enforcement or military vehicle with the ballistic blanket portion hanging off the side of the car. Again, this not only allows easy set up for an individual user, but it also provides additional ballistic protection to the user by basing it on the side of a vehicle. Thus, in a novel fashion, the hooks and straps of the present invention provide the user with an endless array of set up possibilities only limited by the specific circumstance with which the user is presented.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
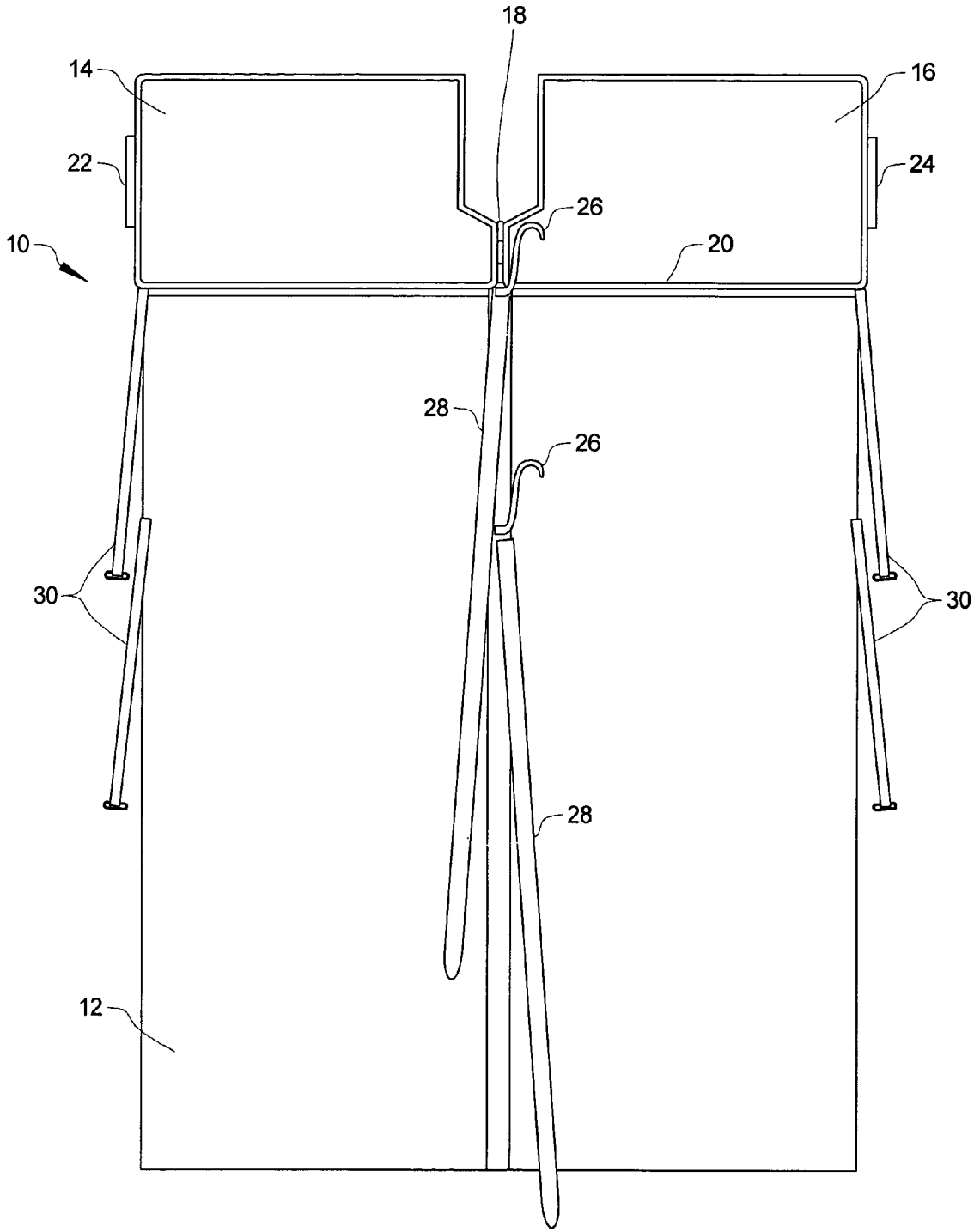
FIG. 1 is a front plan view of the apparatus of the present invention.

Referring to FIG. 1, a device for ballistic protection on an individual is shown and is generally designated by numeral 10. Device (10) is comprised of a ballistic blanket member (12). Ballistic blanket member (12) is selected from any one of a number of varying grades of ballistic blankets as known in the art. Ballistic blanket member (12) is selected based on balancing the need for mobility and individual transportability of device (10) versus the need for varying levels of ballistic protection. In other words, the lower the grade of the ballistic protection of ballistic blanket member (12), the lighter and less bulky device (10) is for transportation; however, device (10) would be less able to withstand heavy fire from high caliber weaponry. Conversely, the higher the grade of ballistic blanket member (12), the greater the protection from high caliber fire that device (10) is able to provide, but then device (10) becomes heavier and more bulky to transport and set-up than its lighter version. Therefore, no matter what the specific need, device (10) may be tailored for the proper protection/transportability ratio, while still maintaining the integrity of device (10).

Still referring to FIG. 1, device (10) is further comprised of two transparent pane members (14, 16). Transparent pane members (14, 16) are preferably comprised of bullet resistant polycarbonate material as is generally known in the art. Transparent pane members (14, 16) may also be selected from various grades of polycarbonate panels depending on the specific mobility versus ballistic protection needs of device (10) similar to the aforementioned tailoring of ballistic blanket member (12). As best seen in FIG. 1, transparent pane members (14, 16) are centrally connected via vertical hinge member (18) such that pane member (14) and panel member (16) may be set at any number of varying angles with respect to one another to provide for the appropriate level of visibility and ballistic protection of the individual user. Also as seen in FIG. 1, transparent pane members (14, 16) are so cut and configured as to provide a centrally located slot for placing a rifle using hinge (18) as a rifle stand. As such, device (10) allows its user to aim and fire a weapon while retaining excellent ballistic cover from return fire.

Figure 4:
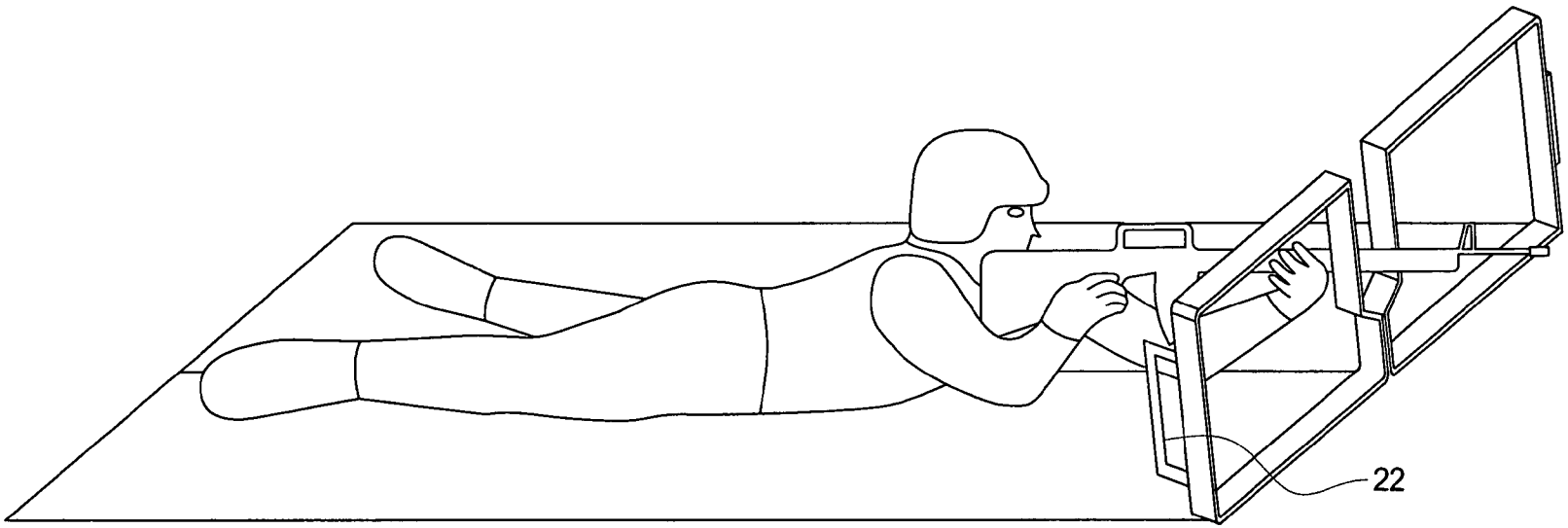
FIG. 4 is a perspective view of the device of the present invention set up for use directly on the ground.

Still referring to FIG. 1, transparent panel members (14, 16) have an outer perimeter lined with an appropriate material as in known in the art. Along the bottom edge of panel members (14, 16) a connecting strip (20) is provided for connecting ballistic blanket member (12) to panel members (14, 16) in any number of ways as is known in the art including appropriate mechanical fasteners, appropriate adhesive, and/or appropriate hook and latch mechanisms. At the outermost perimeter of each pane member (14, 16) are attached stand members (22, 24). Stand members (22, 24) protrude outwardly, as best seen in FIG. 4, for instances when no free standing structures are available to allow an individual to lie in the prone position while monitoring, aiming, and firing upon a target retaining relative cover of device (10).

Figure 2:
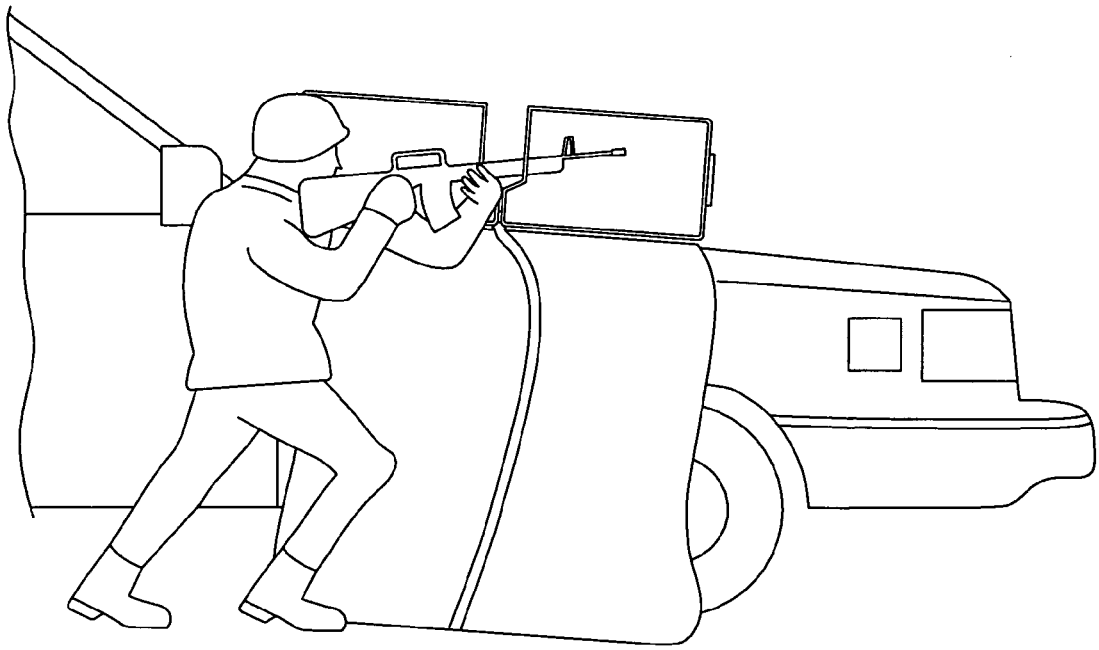
FIG. 2 is a perspective view of the device of the present invention set up for use on the side of an automobile.
Figure 3:
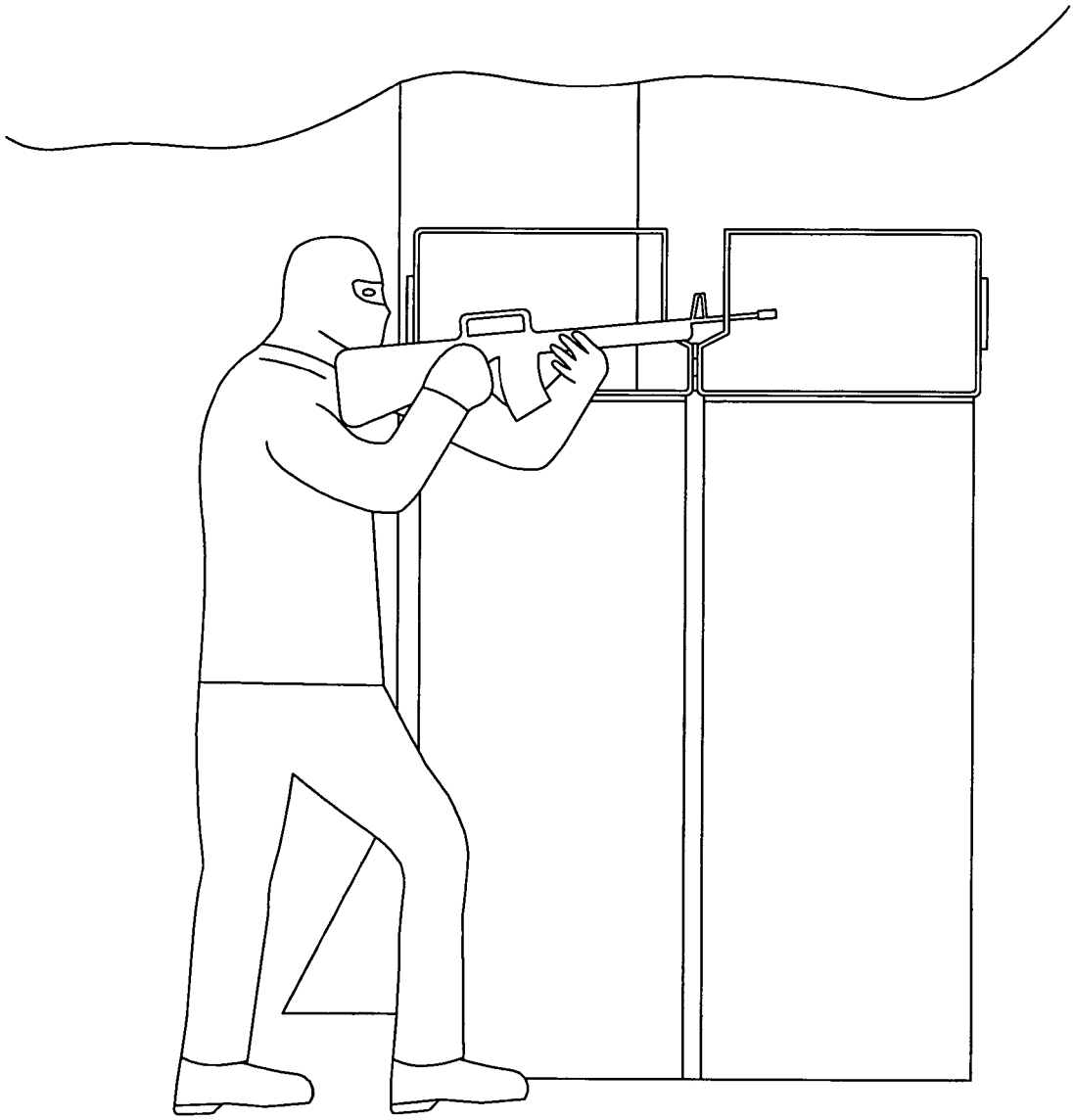
FIG. 3 is a perspective view of the device of the present invention set up for use on the side of a tree trunk.

Referring back to FIG. 1, hook members (26) are attached to device (10) along with central strap members (28) and outer strap members (30). Hook members (26) and strap members (28, 30) are provided on device (10) in allowing for various set up possibilities only limited by the individual user's needs and imagination. For instance, hook members (30) maybe used to help secure device (10) to an open automobile door or the hood of an automobile, as best seen in FIG. 2. Furthermore, the combination of hook members (26) and strap members (28, 30) may be used to set up device (10) by securing the device to a tree trunk or other vertical structure, as best seen in FIG. 3.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. A portable device for ballistic protection of an individual that can be hand-carried into the field by the individual, readily placed in a standalone position without the use of any tools, and can also be readily folded up and stored in a small space, comprising:

a first projectile-resistant transparent pane;

a second projectile-resistant transparent pane;

a hinge to connect the first and second transparent panes such that the first and second transparent panes are configurable at an angle less than 180 degrees with respect to each other so that the device is readily placed and used in a standalone position of use upon any substantially flat surface and readily folded from the standalone position of use into a small space when not in use; and wherein, in a substantially fully open standalone position of the transparent panes, a rifle stand is formed between the panes while the panes substantially shield the individual in a shooting position using the rifle stand; and wherein the rifle stand is shaped to receive and support a forward end of a firearm while the individual peers through space between the panes to take aim; and stand members positioned to readily prop up the panes without tools when the panes are placed in a standalone position of use by the individual, so that the device, when leaned toward the individual under the force of gravity, leans against the stand members which thereby prop up the panes without tools in a standalone position of use.

2. The portable device of claim 1 further comprising a mechanism to readily and removably mount the device to an existing structure without the use of tools.

3. The device of claim 2, wherein the mechanism comprises a strap.

4. The portable device of claim 1, the further comprising a projectile resistant blanket of size to shield substantially the whole body of the individual in a standing position.

5. The portable device of claim 4, wherein different standalone positions of the device protect the individual from projectiles while in a standing, kneeling or lying position.

6. The device of claim 4, wherein the blanket is positionable substantially vertically when the individual is in a standing position, and wherein the blanket is positionable substantially horizontally when the individual is in a prone position.

7. The device of claim 1, further comprising a projectile resistant blanket attachable to at least one of the two panes.

8. A portable ballistic shield for an individual that can be hand-carried by the individual into the field and put into a standalone shielding position without the use of tools, comprising:

a projectile-resistant transparent member that can be folded with stand members to readily stand the transparent member upright in a standalone position of use upon a substantially flat surface by leaning the shield against the stand members, or to fold the shield into a small space, without the use of tools; wherein, in a substantially fully open position of the transparent member, a rifle stand forms in the transparent member to receive and support a rifle while the individual peers through a gap formed in the transparent member.

9. The portable ballistic shield of claim 8, further comprising a mechanism for removably attaching the shield to a structure without the use of tools.

10. The shield of claim 9, wherein the mechanism comprises a hook.

11. The shield of claim 8, further comprising a projectile-resistant blanket; wherein the blanket is positionable substantially vertically when the individual is in a standing position, and wherein the blanket is positionable substantially horizontally when the individual is in a prone position.

12. A portable ballistic shield for an individual, the shield comprising:

a projectile-resistant transparent member comprising at least one part and with an opening in the transparent member to receive and mount a weapon so that the individual may see and shoot from behind the transparent member;

stand members to readily stand the transparent member upright in a standalone position without the use of tools by leaning the shield upon the stand members; and a projectile-resistant blanket connectable to the transparent member, the blanket of size to provide protection to substantially the whole body of the individual in a standing position.

13. The portable ballistic shield of claim 12, further comprising a mechanism for removably attaching the shield to a structure without the use of tools.

14. The shield of claim 13, wherein the mechanism comprises a hook.

15. The portable ballistic shield of claim 12, wherein, when not in use, the transparent member can be folded along with the blanket to a small size to increase portability of the shield.

* * * * *